US008907994B2

(12) United States Patent
Arrington et al.

(10) Patent No.: US 8,907,994 B2
(45) Date of Patent: Dec. 9, 2014

(54) PRINTER CHARACTERIZATION OF PRINT MEDIA

(71) Applicants: Stacy L. Arrington, Raleigh, NC (US); Hye S. Makley, Morrisville, NC (US); Dean F. Herring, Youngsville, NC (US); Jason A. Matteson, Raleigh, NC (US)

(72) Inventors: Stacy L. Arrington, Raleigh, NC (US); Hye S. Makley, Morrisville, NC (US); Dean F. Herring, Youngsville, NC (US); Jason A. Matteson, Raleigh, NC (US)

(73) Assignee: Lenovo Enterprise Solutions (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 13/778,699

(22) Filed: Feb. 27, 2013

(65) Prior Publication Data

US 2013/0208070 A1 Aug. 15, 2013

Related U.S. Application Data

(62) Division of application No. 13/022,378, filed on Feb. 7, 2011, now Pat. No. 8,451,303.

(51) Int. Cl.

| | |
|---|---|
| ***B41J 2/32*** | (2006.01) |
| ***B41J 2/315*** | (2006.01) |
| ***B41J 11/00*** | (2006.01) |

(52) U.S. Cl.

CPC .. *B41J 2/315* (2013.01); *B41J 2/32* (2013.01); *B41J 11/009* (2013.01)

USPC ..... 347/171

(58) Field of Classification Search

USPC ..... 347/171, 190, 191, 193, 194, 197, 198, 347/211, 220, 221, 105; 400/120.01, 400/120.16, 120.17

See application file for complete search history.

(56) References Cited

U.S. PATENT DOCUMENTS

| | | | |
|---|---|---|---|
| 5,754,213 | A | 5/1998 | Whritenor |
| 6,141,028 | A | 10/2000 | Aruga |
| 6,313,856 | B1 | 11/2001 | Ulrich |
| 6,795,191 | B2 | 9/2004 | Barbehenn |
| 6,903,358 | B2 | 6/2005 | Kim |
| 6,972,875 | B2 | 12/2005 | Brewster |

(Continued)

FOREIGN PATENT DOCUMENTS

| | | | |
|---|---|---|---|
| EP | 1958785 | A1 | 8/2008 |
| JP | 2005297752 | A | 10/2005 |
| JP | 2008230230 | A | 10/2008 |

OTHER PUBLICATIONS

Japanese Patent Office, "IIE114687—Office Action 100037, dated Dec. 23, 2013", 16 pages.

(Continued)

*Primary Examiner* — Kristal Feggins

(74) *Attorney, Agent, or Firm* — Katherine S. Brown; Jeffrey L. Streets

(57) ABSTRACT

A printer has a heat source disposed adjacent a temperature sensor to transfer heat upon activation across a portion of an introduced print media to the temperature sensor and a controller to receive a signal from the temperature sensor and to obtain a temperature signature generally identifying attributes of the introduced print media and to adjust print head settings in response to the identified attributes. The printer may further comprise a sensor to detect access to a print media storage compartment and to initiate examination of the heat transfer properties of the introduced print media upon detecting that the print storage compartment has been accessed.

9 Claims, 4 Drawing Sheets

(56) References Cited

U.S. PATENT DOCUMENTS

| | | | | |
|---|---|---|---|---|
| 6,984,013 | B2 | 1/2006 | Arqullevich et al. | |
| 7,083,245 | B2 | 8/2006 | Yamamoto | |
| 7,259,826 | B2 | 8/2007 | Fukushima et al. | |
| 7,313,067 | B2 * | 12/2007 | Higashiyama | 347/105 |
| 7,354,208 | B2 | 4/2008 | Silverbrook | |
| 7,357,487 | B2 | 4/2008 | Kusunoki | |
| 7,528,852 | B2 | 5/2009 | Lee | |
| 7,614,716 | B2 | 11/2009 | Higashiyama | |
| 7,646,479 | B2 | 1/2010 | Kokubo | |
| 7,959,247 | B2 | 6/2011 | Suzuki | |
| 2004/0169713 | A1 | 9/2004 | Niino et al. | |
| 2005/0134675 | A1 * | 6/2005 | Higashiyama | 347/221 |
| 2005/0206683 | A1 | 9/2005 | Kusunoki | |
| 2006/0017892 | A1 * | 1/2006 | Fukushima et al. | 355/29 |
| 2008/0205437 | A1 | 8/2008 | Cole | |
| 2010/0033547 | A1 * | 2/2010 | Yamada | 347/211 |

OTHER PUBLICATIONS

Seiko I Infotech Inc., "Inkjet Printer and Inkjet Printing Method", Espacenet, JP2008230230(A) English Absrtact, Oct. 2, 2008, 1 page.

Yokohama Rubber Co Ltd, "Pneumatic Tire", Espacenet, JP2005297752(A) Abstract, Oct. 27, 2005, 1 page.

Seiko I Infotech Inc., "Ink-Jet Printer Device and Ink-Jet Printing Method", Espacenet, EP1958785 (A1), Abstract, Aug. 20, 2008, 1 page.

* cited by examiner

PRINTER CHARACTERIZATION OF PRINT MEDIA

CROSS-REFERENCE TO RELATED APPLICATIONS

This application is a divisional of U.S. patent application Ser. No. 13/022,378 filed on Feb. 7, 2011.

BACKGROUND

1. Field of the Invention

The present invention relates to thermal printers and the print media used by thermal printers.

2. Background of the Related Art

Printers are used to record and provide printed information and advertisements to consumers that use automatic teller machines, self-serve kiosks, self-serve fuel pumps and movie ticket kiosks, and to consumers that receive receipts relating to purchases of goods and products. Printers are generally stocked with a supply of print media, such as paper stored in a roll with an exposed end accessible to be fed through a pathway adjacent to a print head. The printer may comprise rollers coupled to one or more servo-motors controlled by a controller to position and advance the print media to receive printed information thereon. As the rollers draw print media from the roll, the roll of print media rotates to spool out additional portions of print media until the roll is depleted and then replaced with a new roll. A cutter may be disposed adjacent to a slot in a printer enclosure through which the print media is dispensed to the user, such as a consumer, attendant, or clerk. The cutter cuts the print media so that the consumer can retrieve and retain a portion of print media bearing the printed information.

A thermal printer (or direct thermal printer) produces a printed image by selectively heating coated print media, or thermal paper, as it is commonly known, when the print media passes across the thermal print head. A coating applied to the print media turns black or some other color in the areas where localized heat is applied by the print head in patterns corresponding to an image to be printed on the print media, such as alphanumeric characters or other images. A thermal print head may be capable of printing on a several different types of print media, but the thermal print head may require adjustment of settings to provide optimal quality of printing on a given print media. If the new roll of print media is a different type than the previous roll of print media, the thermal print head settings need to be adjusted.

BRIEF SUMMARY

One embodiment of the present invention provides a printer comprising a temperature sensor, a heat source disposed adjacent the temperature sensor to form a pathway to receive a print media there between, and a controller embodying a logic structure to obtain a temperature signature corresponding to a signal from the temperature sensor during heat transfer from the heat source across the print media to the temperature sensor.

DETAILED DESCRIPTION

Figure 1:
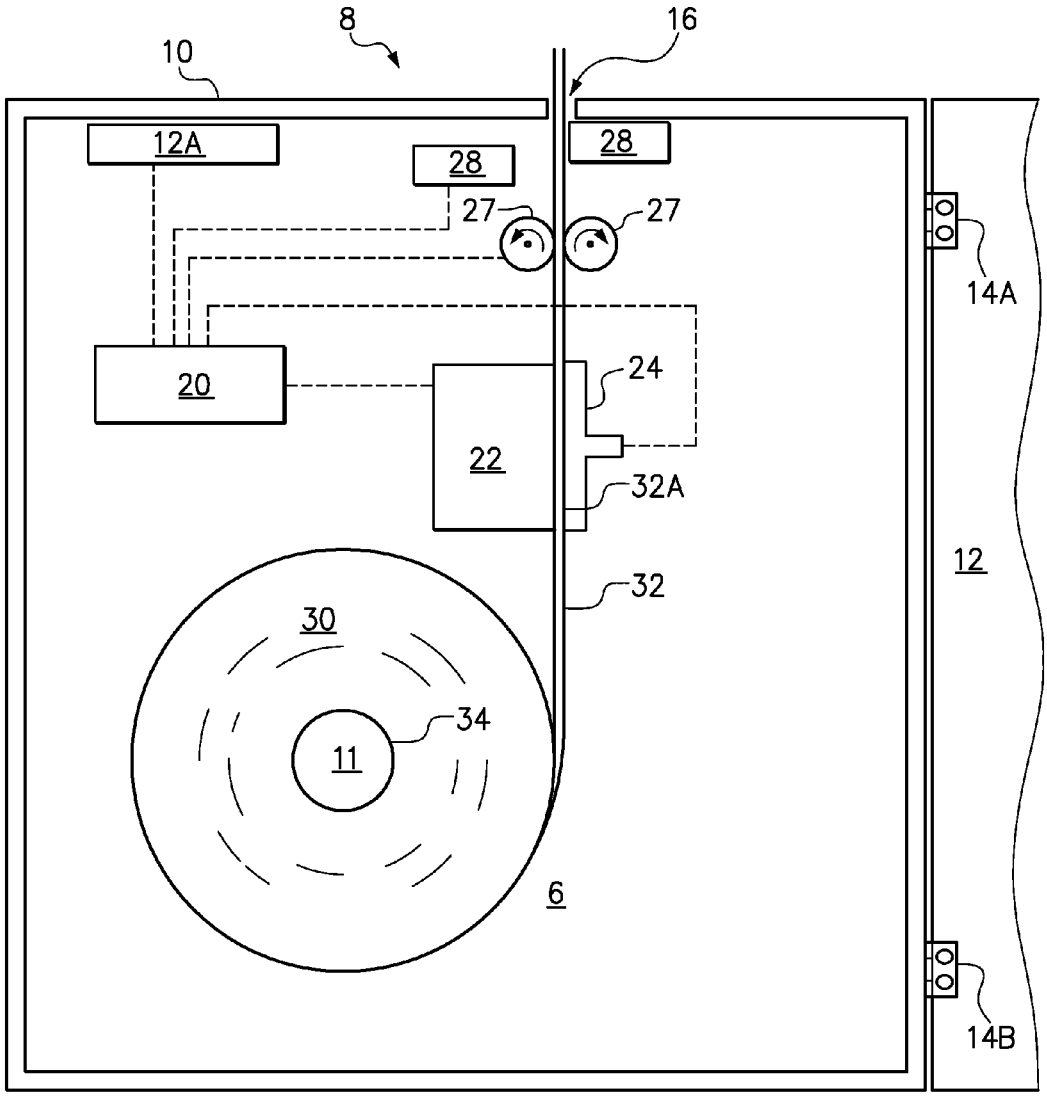
FIG. 1 is a cross-sectional side view of an embodiment of a printer having an automatically adjustable print head to print information on a print media.

One embodiment of the invention provides a printer having an apparatus to detect a property of a print media introduced into the printer to receive localized heat and produce a printed image, and to automatically adjust a setting of a thermal print head to optimize the quality of the image printed on the print media.

An alternate embodiment of the invention provides a printer having an apparatus to detect a property of a print media introduced into the printer to receive localized heat and produce a printed image, and to automatically display a message, using, for example, an LED or LCD display, to the user of the printer, wherein the message relates to the suitability and/or the compatibility of the introduced print media with the printer.

Another alternate embodiment of the invention provides a printer having an apparatus to detect a property of a print media introduced into the printer to receive localized heat and produce a printed image, and to automatically disable the printer to prevent, for example, unnecessary consumption of the print media and/or damage to the printer, such as, for example, damage to the print head of the printer due to the use of an incompatible print media.

In one embodiment, a temperature sensor is disposed within the printer and used to measure an amount of heat transferred from a heat source positioned on one side of the introduced print media to the temperature sensor positioned adjacent to the heat source but on the opposite side of a single layer of the introduced print media. The temperature sensor generates one or more signals to a controller corresponding to the sensed temperature, and the controller is programmed to respond to the signal from the temperature sensor and to adjust or optimize the settings of the print head to print on the introduced print media.

The temperature sensed by the temperature sensor will vary according to the type of print media. Factors that may affect the amount of heat transferred across the portion of the print media include the composition of the print media, the thickness of the print media, the composition of any coating(s) applied to the print media and the thickness of the coating(s) applied to the print media.

For example, but not by way of limitation, a first print media comprising a first material, such as cellulose, of a given thickness, for example, 0.002 inches (2 mils)(0.051 mm) may provide substantially different heat transfer from the heat source across the print media to the temperature sensor than would a second material, such as polymer film, of the same thickness. The substantial difference in the amount of heat transferred across the polymer film print media as compared to the cellulose print media of the same thickness is due to the substantially different thermal conductivity coefficient of polymer film as compared to that for cellulose. For example, typical thermal print media with a cellulose composition may have a thermal resistance of about 0.05° Celsius/Watt, whereas a typical thermal print media with a polymer composition may have a thermal resistance of about 0.19° Celsius/Watt. Accordingly, the heat transfer through a polymer film is expected to be substantially greater than the heat transfer through a cellulose paper of the same thickness, all other variables remaining equal.

As a further example, a first print media comprising a polymer film having a thickness of 2 mils (0.051 mm) will impair heat transfer from the heat source to a temperature sensor substantially more than a second print media comprising an identical material (polymer film) having a thickness of only 1 mil (0.025 mm). The substantial reduction in the amount of heat transferred across the first, thicker polymer film print media as compared to the second, thinner polymer film print media is due to the substantially larger thermal resistivity of thicker polymer film as compared to the thinner polymer film.

As another example, a first print media comprising a polymer film having a given thickness and also having a thermal transfer coating in an applied coating thickness of 0.01 mil (0.0025 mm) thereon will impair heat transfer from a heat source to a temperature sensor substantially more than a second print media comprising the same thickness of polymer film but having no thermal transfer coating. A thermal transfer coating may be applied to a print media to optimize the transfer of heat from a component of the print head to the print media; i.e., to the cellulose or polymer film base material of the print media. The substantial reduction in the amount of heat transferred across the first, coated polymer film print media to the temperature sensor disposed opposite the print media from the heat source as compared to the second, uncoated polymer film print media of the same thickness is due to the larger thermal resistivity to heat transfer across the coated polymer film as compared to the relatively reduced resistivity to heat transfer across the uncoated polymer film.

A temperature signature, as that term is used herein, is a temperature profile over an interval of time. A temperature signature may, in one embodiment, be a graph or trace of the temperature obtained at the temperature sensor and reflecting the transition from a first temperature to a second temperature, wherein the first temperature corresponds to no heat transfer from a heat source to the temperature sensor and the second temperature corresponds to a generally stabilized temperature reading at the temperature sensor reflecting a generally stabilized rate of heat transfer from the heat source to the temperature sensor. In an alternate embodiment, a temperature signature may be a trace of the temperature sensed at the temperature sensor and reflecting the transition from a first temperature to a second temperature and from the second temperature to a third temperature which may, in some embodiments, be generally the same as the first temperature. In the latter embodiment, the first temperature may correspond to no heat transfer from a heat source to the temperature sensor, the second temperature may correspond to a generally stabilized temperature reading at the temperature sensor reflecting a generally stabilized rate of heat transfer from the heat source to the temperature sensor, and the third temperature may correspond to restoration of the heat source to a deactivated state with no heat transfer from the heat source to the temperature sensor. It should be understood that the steepness of the trace, which represents the rate of change of the temperature sensed at the temperature sensor, and the stabilized rate of heat transfer, which corresponds to the thermal resistivity of the introduced print media to heat transfer across the print media, are examples of characteristics of the temperature signature that may be obtained and then compared by the controller to known temperature signatures to identify the print media and then adjust the print settings for optimal printing quality.

One embodiment of the present invention provides a method, comprising generating a predetermined amount of heat in a predetermined pattern for a predetermined time period on a first surface of a print media, sensing the temperature on a second surface of the print media during at least the predetermined time period to obtain a temperature signature for the print media, and identifying the print media according to the closest correspondence between the obtained temperature signature and a plurality of predetermined temperature signatures that are each associated with a known print media.

Optionally, it is possible to generate a predetermined amount of heat in a predetermined pattern for a predetermined time period on a first surface of a print media by causing a print head in a thermal printer to print a predetermined test pattern on the print media. Still further, it is possible to determine that a current print media is a different type that a previous print media within a thermal printer. Accordingly, the method may alert a user to change one or more print head settings of the thermal printer, such as by displaying a message relating to the one or more print head settings. Alternatively, one or more print head settings of a thermal printer using the print media may be automatically applied, wherein the one or more settings are predetermined for use with the known print media. A print head setting may be applied by either confirming that current print head settings of the thermal printer are correct for the print media identified, by modifying the one or more print head settings of the thermal printer with values associated with the print media identified.

In a further embodiment, the foregoing method is performed in response to determining that the print media in the thermal printer has been restocked. For example, it may be determined that the print media has been restocked by detecting that a door to a print media storage compartment of the thermal printer has been opened or closed.

One embodiment of the method includes detecting a user's closing of a door to a printer compartment in which the print media is stored for introduction to the print head of the printer. An activating signal may be generated and sent to a heat source, such as a print head. A temperature sensor obtains a temperature signature characterizing heat transfer across the print media, such that the obtained temperature signature may be compared to at least one temperature signature stored in a database for a print media of a known physical/material construction. Accordingly, the print media is identified as being the same type as a known print media that is associated with a temperature signature in the database most closely corresponding to the obtained temperature signature. One or more print head settings associated with the identified print media may be applied to optimize print quality.

One embodiment of the present invention provides a method for detecting at least one of the type of print media and the thickness of print media introduced in a print media storage compartment of a printer. The method comprises the steps of disposing a portion of a known print media between a heat source and a temperature sensor, using the heat source to generate and transfer heat from the heat source and across the print media to the temperature sensor, using a temperature sensor and a controller to sense a temperature signature corresponding to the heat transferred from the heat source across the known print media to the temperature sensor, comparing the sensed temperature signature to a known temperature signature stored in a database accessible to the controller and corresponding to a print media having at least one of a known material thickness and a known type of the known print media, selecting from the database at least one stored temperature signature that closely matches the sensed temperature signature, retrieving one or more print head settings corresponding to the selected at least one stored temperature signature, and applying the print head settings to optimize the quality of image printed by the printer on the introduced print media.

Yet another embodiment of the present invention provides a computer program product including computer usable program code embodied on a computer usable storage medium. The computer program product may comprise computer usable program code for performing any of the foregoing methods, or any portion of the foregoing methods.

A still further embodiment of the present invention provides a system comprising a temperature sensor, a heat source disposed adjacent the temperature sensor to form a pathway receiving a print media there between, and a controller embodying a logic structure to obtain a temperature signature corresponding to a signal from the temperature sensor during heat transfer from the heat source across the print media to the temperature sensor. The controller may further embody a logic structure for comparing the obtained temperature signature with at least one known temperature signature corresponding to a known print media, and identifying the print media based on the comparison of the obtained temperature signature to the at least one known temperature signature. The controller may still further embody a logic structure to modify at least one print head setting to print on a type of print media corresponding to at least one known temperature signature identified by the controller as most closely corresponding to the obtained temperature signature.

Such a controller may have a logic structure or be programmed to compare an obtained temperature signature to at least one temperature signature in a database of temperature signatures containing isolated features correlating to at least one of the base material, a base material thickness, a coating, and an absence of coating of a print media. Still further, the controller may have a logic structure or be programmed to compare the obtained temperature signature to a plurality of temperature signatures correlating to known print media characteristics and to determine the material, thickness and coating of the print media. In a specific embodiment, the controller may be programmed to compare the obtained temperature signature to a temperature signature corresponding to a cellulose-based print media, compare the obtained temperature signature to a temperature signature corresponding to a polymer film-based print media, and assign at least one of a cellulose-based material attribute and a polymer film-based material attribute to the print media. Still further, the controller may be programmed to compare the obtained temperature signature to an isolated temperature signature corresponding to a coating applied to print media, and assign at least one of a coating present attribute and a coating absent attribute to the print media. With these attributes determined, the controller may adjust a print head setting to print on the assigned material attribute, the assigned coating attribute, or a combination thereof.

The above-described methods may be implemented in the printer of FIG. 1. FIG. 1 is an elevation view of an embodiment of a printer 8 comprising a housing 10 having a print media storage compartment 6 and a door 12 that is movable between a closed position and an open position (shown in FIG. 1) on hinges 14A and 14B. The printer 8 also includes a controller 20, a heat source 22, and a temperature sensor 24 disposed generally adjacent the heat source 22. Electronically actuatable cutting elements 28 are positioned adjacent a slot 16 in the housing 10, and a spindle 11 is disposed to receive and movably support a roll 30 of print media 32 having a core 34 at its center. In operation, the print media 32 is extended between the heat source 22, such as a print head, and the temperature sensor 24, then between a pair of rollers 27, between the cutting elements 28 and through the slot 16. At least one of the rollers 27 is typically coupled to a motor for controllably advancing the print media. A sensor 12A detects the position of at least a portion of the door 12 and generates a signal to the controller 20 in response thereto.

The printer 8 of FIG. 1 enables the determination of the type of print media 32 introduced into the printer 8 to be printed upon by the printer 8. The interaction and function of the components listed above in connection with the printer 8 of FIG. 1 will become clear by consideration of the flowchart of FIG. 2 which illustrates a first method of the present invention, and the flowchart of FIG. 3 which illustrates steps of a specific example embodiment of a method of adjusting a print head to optimize printing on a print media.

Figure 2:
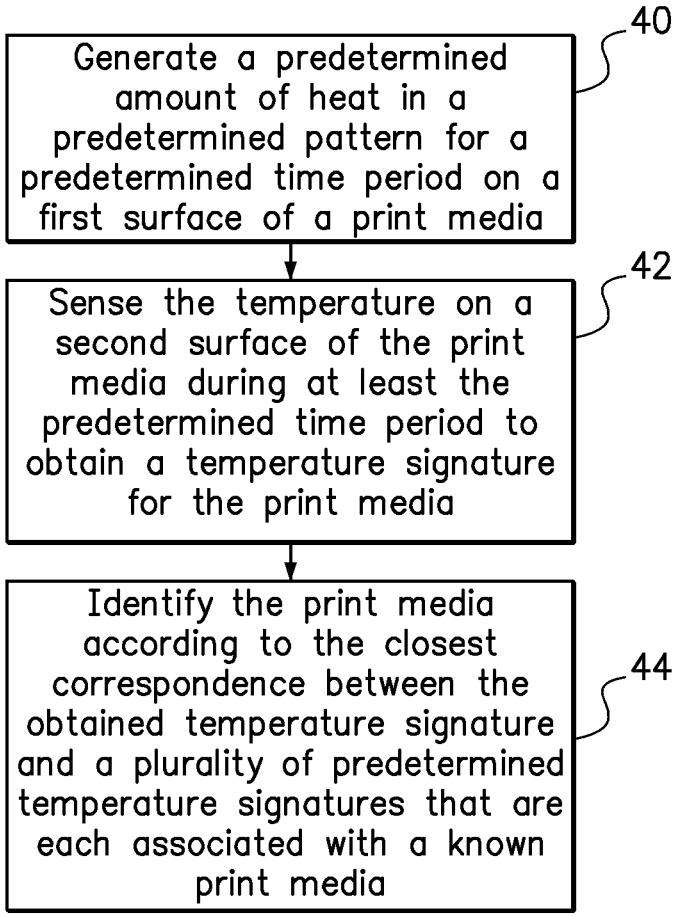
FIG. 2 is a flowchart illustrating a method of identifying a print media.

FIG. 2 is a flowchart of a method of identifying a print media. The method includes generating a predetermined amount of heat in a predetermined pattern for a predetermined time period on a first surface of a print media in step 40. Optionally, the heat may be applied by causing a print head to perform a test pattern. In step 42, the temperature on a second surface of the print media is sensed during at least the predetermined time period to obtain a temperature signature for the print media. The print media is identified in step 44 according to the closest correspondence between the obtained temperature signature and a plurality of predetermined temperature signatures that are each associated with a known print media.

Figure 3:
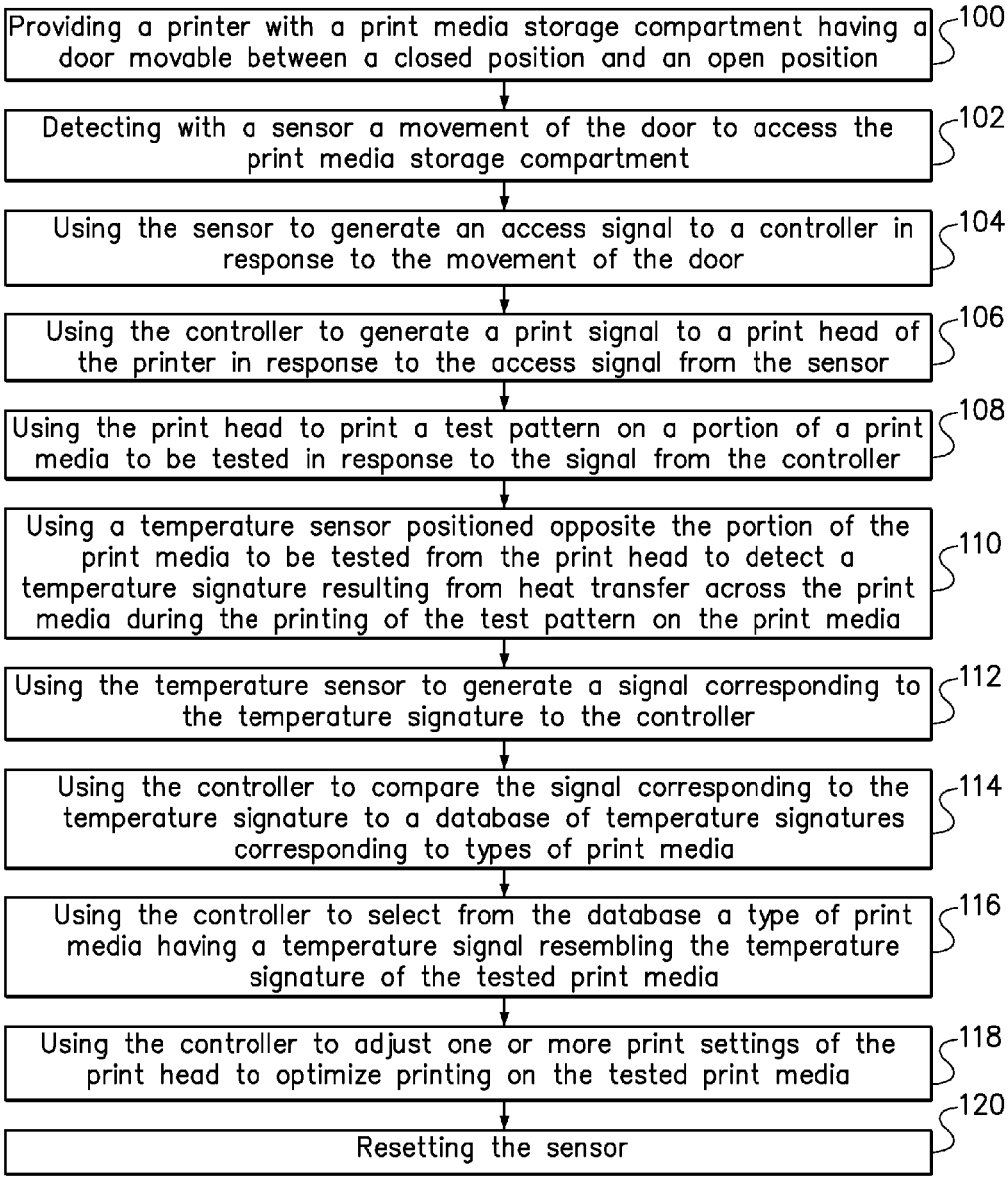
FIG. 3 is a flowchart illustrating a method of automatically adjusting a print head to print on print media of a detected type.

FIG. 3 is a flowchart illustrating the steps of an embodiment of a method to test a print media to determine one or more properties thereof, and to automatically adjust one or more settings of a print head to optimize the quality of the printed matter received on the tested print media. Element numbers corresponding to the printer 8 of FIG. 1 are shown in parentheses in the following description of the embodiment of the method.

The embodiment of the method illustrated in FIG. 3 comprises: providing a printer (8) with a print media storage compartment (6) having a door (12) movable between a closed position and an open position (shown in FIG. 1) in step 100; detecting with a sensor (12A) a movement of the door (12) to access the print media storage compartment (6) in step 102; using the sensor (12A) to generate an access signal to a controller (20) in response to the movement of the door (12) in step 104; using the controller (20) to generate an activating signal to a heat source (22) of the printer (8) in response to the access signal from the sensor (12A) in step 106; using the heat source (22) to generate heat that is, at least in part, transferred across a portion (32A) of a print media (32) to be tested in response to the signal from the controller (20) in step 108; using a temperature sensor (24) positioned opposite the portion (32A) of the print media (32) to be tested from the heat source (22) to detect a temperature signature (see FIGS. 3-6) resulting from heat transfer across the print media (32) during the printing of the test pattern on the print media (32) in step 110; using the temperature sensor (24) to generate a signal corresponding to the temperature signature to the controller (20) in step 112; using the controller to compare the signal corresponding to the temperature signature to a database of temperature signatures corresponding to known types of print media in step 114; using the controller (20) to select from the database one or more stored printer settings for optimal printing on a known type of print media having a temperature signal generally resembling the temperature signature of the tested portion (32A) of the print media (32) in step 116; using the controller (20) to adjust one or more print settings of the print head to optimize printing by the printer (8) on the print media in step 118; and resetting the sensor in step 120.

Returning to FIG. 1, the sensor 12A used to detect a position of the door 12 to the print media storage compartment 6 of the printer 8 may be, in one embodiment, a magnetic or electronic sensor positioned to detect a magnet or electronically detectable transponder, respectively, that is coupled to the door 12 at a location that will cause the magnetic or electronic sensor to move into close proximity to the sensor 12A during at least one of the opening or closing of the door 12. For example, but not by way of limitation, the magnet (not shown) on the door 12 may be brought into close and detectable proximity near the sensor 12A when the door 12 is moved on the hinges 14A and 14B to a closed position (not shown) from the open position illustrated in FIG. 1. Alternately, the sensor 12A may comprise a switch having an switch open position obtained upon closure of the door 12 and a switch closed position obtained upon movement of the door 12 on the hinges 14A and 14B from a closed position to an open position such as, for example, the open position illustrated in FIG. 1.

Again referring to FIG. 1, the temperature sensor 24 may, in one embodiment, be a solid state device such as a temperature sensitive resistor (thermistor), a thermocouple or bimetallic strips selected to generate a measurable micro-current corresponding to the temperature sensed by the temperature sensor 24. A micro-current signal from the temperature sensor 24 provided to the controller 20 enables the controller 20 to sense the micro-current signal from the temperature sensor 24 to the controller 20 over a time interval and to record the temperature signature for use in optimizing printer settings.

The signal from the temperature sensor 24 may vary over the time interval and may be graphically represented using a standard line graph having temperature (or, alternately, micro-amps) along the ordinate (y-axis) and the time (in microseconds) along the abscissa (x-axis). In one embodiment of a method of optimizing print settings of a printer, a database comprising a plurality of temperature signatures corresponding to a plurality of known types of print media may be programmed into, or made electronically available to, the controller 20 to provide for ready comparison to a temperature signature of a tested print media so that the tested print media may be identified by correlation of the temperature signature with a temperature signature in the database corresponding to a known type of print media. After the correlation is made, the controller 20 may be used to apply (either confirm or modify) print settings of a print head for printing on the type of print media having a temperature signature, under generally identical test conditions, that correlates most closely with the temperature signature obtained by the temperature sensor 24 and controller 20.

Identifiable features and characteristics of a sensed temperature signature may be used in correlating the sensed temperature signature to a known temperature signature. For example, a sensed temperature signature may comprise a ramp-up feature that reflects rapid heating of the temperature sensor 24 by the activated heat source 22 from a baseline temperature, corresponding to minimal or no heat transfer from the heat source to the temperature sensor 24, to an elevated and/or stabilized temperature plateau. As another example, the sensed temperature signature may further comprise a ramp-down feature that reflects rapid cooling of the heated temperature sensor 24 from an elevated and/or stabilized temperature corresponding to the plateau to or towards the baseline temperature. Depending on the material, thickness and/or coatings applied to a print media, the ramp-up and ramp-down features may be shallower and/or steeper for one type of print media as compared to another.

One method of automatically adjusting the settings of a printer to optimize printing on an introduced print media comprises the steps of characterizing one or more types of print media and creating a database accessible to a controller for comparing an obtained temperature signature of the introduced print media to a temperature signature(s) of a known type(s) of print media. The characterization of a type of print media may comprises the steps of, for example, obtaining a print media with known properties (i.e., known thickness, known material and known coatings), introducing the print media of known properties into the printer, activating the heat source to generate heat transfer across a portion of the print media of known properties to the temperature sensor, using the temperature sensor and a controller to sense a temperature signature for the print media of known properties, and recording the temperature signature for the print media of known properties for later access by the controller. These steps may be repeated for a second known type of print media, a third and so on to provide a database of temperature signatures for comparison with a sensed temperature signature for automated estimation and/or determination of a type of print media so that printer settings may be automatically confirmed or adjusted for an introduced type of print media.

In one embodiment of the method and in one embodiment of the printer, the heat source 22 used to generate heat transfer across the portion 32A of the print media 32 to be sensed at the temperature sensor 24 may be a thermal print head. A thermal print head prints the printed matter, for example, images or alphanumeric characters, on the print media by application of highly localized heat to the print media in a pattern that corresponds to the images or alphanumeric characters to be printed on the print media. The print media is predisposed to change color as a result of the application of heat, and the print media may be treated using a chemical that promotes or enables color change in response to the applied localized heat according to the pattern necessary to provide the image or alphanumeric characters. The present invention, therefore, may be used in connection with a thermal printer because the quality of the printed matter disposed onto the print media using a thermal printer may be particularly sensitive to the nature and character of the print media.

Figure 4:
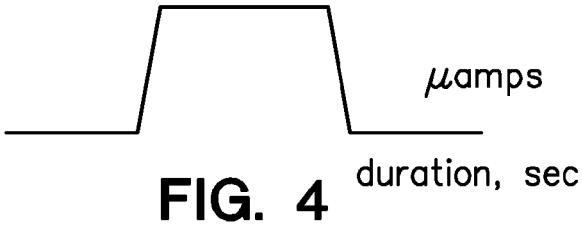
FIG. 4 is a graphical representation of a first temperature signature sensed by a temperature sensor and a controller, wherein the first temperature signature corresponds to heat transferred from a heat source to the temperature sensor through a portion of a first type of print media.

FIG. 4 illustrates a first known temperature signature produced by activating a print head (heat source) to print a test pattern on (and to transfer heat across) a portion of a first type of print medium comprising a cellulose material having no coating thereon. The first known temperature signature comprises a generally trapezoidal-shaped trace having a ramp-up feature and a generally equally steep ramp-down feature separated one from the other by a generally flat, square-shouldered elevated and stabilized feature there between.

Figure 5:
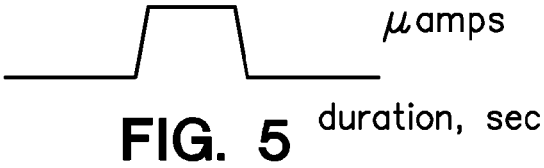
FIG. 5 is a graphical representation of a second temperature signature sensed by a temperature sensor and a controller, wherein the second temperature signature corresponds to heat transferred from a heat source to the temperature sensor through a portion of a second type of print media, which is thicker than the first type of print media of FIG. 4.

FIG. 5 illustrates a second known temperature signature produced by activating the same print head (heat source) used in connection with the first known temperature signature of FIG. 4 to print the same test pattern on (and to thereby transfer heat across) a portion of a second known type of print medium comprising the same material (cellulose) as the print media relating to FIG. 4 and having no coating like the print media relating to FIG. 4, but having a greater thickness than the print media of FIG. 4. The temperature signature illustrated in FIG. 5 also comprises a generally trapezoidal-shaped trace, but one that is smaller in amplitude and narrower in width as compared to the temperature signature of FIG. 4.

Having these two known temperature signatures may enable the use of a controller programmed to recognize a third type of print media that is dissimilar, at least in some respect, to both the first and second known print media relating to FIGS. 4 and 5. For example, the temperature signature of FIG. 3 may relate to an uncoated, cellulose print media having a material thickness of 0.002 inches (0.051 mm), and the temperature signature of FIG. 5 may relate to an uncoated, cellulose print media having a greater thickness of 0.003 inches (0.076 mm). It should be understood that conventional extrapolation or interpolation principles may be applied using a controller and appropriate programming to enable the use of the invention to identify types of uncoated, cellulose print media having a thickness of less than 0.002 inches (0.051 mm) or more than 0.003 inches (0.076 mm), or between these values, based on the same general nature and character (i.e., shape) of the temperature signature but with modified amplitude and/or width of the response. For example, the use of an identical heat generating event in the characterization of the first known type of print media and the second known type of print media is critical so that the variations in the second temperature signature from the first temperature signature are attributable to the known physical differences (thickness) between the first known type of print media and second known type of print media. It is evident by comparing FIGS. 4 and 5 that the increased thickness of the cellulose-based print media, all other variables being held constant, results in the second temperature signature having a profile identical in shape to the profile of the first temperature signature due to the identical uncoated, cellulose material, but the increased thickness decreases the amplitude and the width of the trace according to the increase in thickness of the material.

Figure 6:
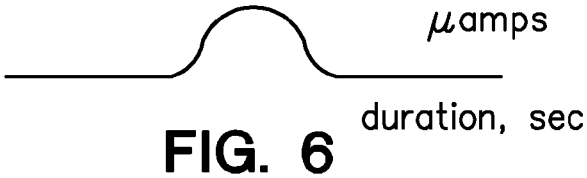
FIG. 6 is a graphical representation of a third temperature signature sensed by a temperature sensor and a controller, wherein the third temperature signature corresponds to the heat transferred from a heat source to a temperature sensor through a portion of a third type of print media comprising the first type of print media relating to FIG. 4 but also having a thermal coating applied thereon.

FIG. 6 illustrates a temperature signature obtained by testing a third known print media comprising the print media used to obtain the temperature signature of FIG. 3 (cellulose print media having a material thickness of 0.002 inches (0.051 mm)) but with a 0.0002 inches (0.0051 mm) thick thermal coating applied to the surface. The third known temperature signature of FIG. 6 comprises a generally dome-shaped trace absent the squared-shoulders seen in FIG. 4 for the uncoated print media and may reflect, for example, the general shape of a temperature signature of a cellulose print media having a thermal coating applied thereto.

Figure 7:
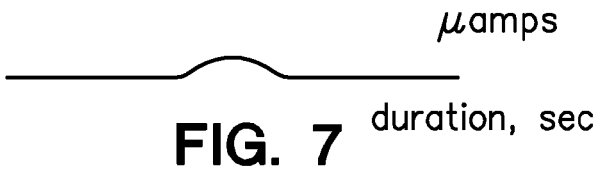
FIG. 7 is a graphical representation of an isolated temperature signature attributable to the thermal coating added to the first type of print media related to FIG. 4 to provide the third type of print media of FIG. 6.

FIG. 7 illustrates an isolated temperature signature attributable to the thermal coating applied to the material relating to the temperature signature of FIG. 4 to produce the temperature signature of FIG. 6, and is obtained by subtracting the temperature signature of FIG. 4 from the temperature signature of FIG. 6 to isolate and graphically illustrate the resistivity to heat transfer added to the material relating to FIG. 4 by application of the thermal coating to provide the material relating to FIG. 6. The isolated thermal coating temperature signature of FIG. 6 is substantially smaller in amplitude as compared to the temperature signature of FIG. 4, and may reflect, for example, the amount of resistivity to heat transfer that may be attributed to the application of a thermal coating of 0.0002 inches to any print media.

Figure 8:
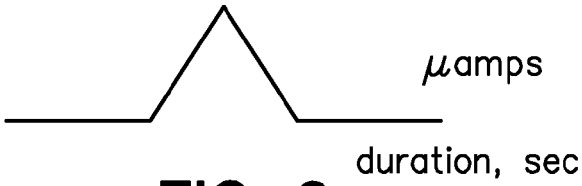
FIG. 8 is a graphical representation of a fourth temperature signature sensed by a temperature sensor and a controller, wherein the fourth temperature signature corresponds to heat transferred from a heat source to the temperature sensor through a portion of a fourth type of print media.

FIG. 8 is a graphical representation of a fourth temperature signature obtained by a temperature sensor and a controller, and corresponding to heat transferred from a heat source across a portion of a fourth type of print media comprising, for example, a polymer film. The fourth known temperature signature of FIG. 8 comprises a generally triangular trace having a ramp-up feature and an adjacent and generally equally steep ramp-down feature adjacent, not separated one from the other by a stabilized feature there between. Further temperature signatures corresponding to polymer film print media of varying thicknesses may be obtained in the same manner as described above in connection with the varying thicknesses of cellulose print media relating to FIGS. 4 and 5.

It should be understood that by obtaining and graphically and/or mathematically manipulating these known temperature signatures corresponding to FIGS. 4-8, a program may be devised to analyze a temperature signature obtained upon introduction of a print media into a printer. For example, the characteristic features of the exemplary temperature signatures illustrated in FIGS. 4-8 may be used to identify the base material of the introduced print media by identifying one of the square-shouldered feature or the elevated and stabilized feature of a cellulose print media or the more triangular feature (absent a stabilized feature) of the polymer film print media, and by further using the isolated temperature signature to determine the presence or absence of a thermal coating layer. It should be understood that this same approach may be used to identify the thickness of the base material (compare FIGS. 4 and 5) and the thickness of a thermal coating applied thereto, and then to automatically adjust the settings of a print head for optimal print quality on that identified print media.

It should be understood that the examples of temperature signatures illustrated in FIGS. 4-8 are merely for purposes of illustration, and actual temperature signatures may vary. FIGS. 4-8 merely represent one possible collection of temperature signatures that correspond to varying types of print media that vary by the nature of the base material, the thickness of the base material, and the presence or absence of a thermal coating. It should be understood that, in a preferred embodiment, a thermal print head of a thermal printer may be used to generate the heat to be transferred to the temperature sensor over a time interval, and the signal produced by the temperature sensor may be recorded over the time interval to produce the temperature signature. It is also possible to provide a heat source that is separate and apart from the print head. It should be understood that the temperature sensor may be integral with a print media support or print media back-up member that supports the position of the print media as it receives printed matter from the print head, or the temperature sensor may be separate and apart from the print media support or back-up member. The temperature sensor and/or the heat source may be movable between a deployed position and a retracted position. The controller may serve functions within the printer other than sensing temperature signatures and adjusting printer settings, and may be a central, shared controller that operates the primary functions of the printer.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A printer, comprising:

a temperature sensor;

a print head disposed adjacent the temperature sensor to form a pathway to receive a print media therebetween; and a controller embodying a logic structure to obtain a temperature signature corresponding to a signal from the temperature sensor during heat transfer from the print head across the print media to the temperature sensor, wherein the obtained temperature signature is obtained while the print head performs a test pattern.

2. The printer of claim 1, further comprising:

a housing having a print media storage compartment that is accessible through a door that is movable between a closed position and an open position; and a door sensor that detects the position of at least a portion of the door and generates a signal to the controller in response thereto.

3. The printer of claim 2, further comprising:

electronically actuatable cutting elements positioned adjacent a slot in the housing, and a spindle disposed to receive and movably support a roll of print media.

4. The printer of claim 3, wherein the print media extends between the heat source and the temperature sensor, then between a pair of rollers, between the cutting elements and through the slot.

5. The printer of claim 4, wherein at least one of the rollers is coupled to a motor for controllably advancing the print media.

6. The printer of claim 2, wherein the controller further embodies a logic structure to send an activating signal to the print head in response to receiving a signal from the door sensor indicating that the door was opened.

7. The printer of claim 1, the controller further embodying a logic structure to compare the obtained temperature signature with at least one known temperature signature corresponding to a known print media, and to identify the print media based on the comparison of the obtained temperature signature to the at least one known temperature signature.

8. The printer of claim 7, the controller further embodying a logic structure to modify at least one print head setting to print on a type of print media corresponding to at least one known temperature signature identified by the controller as most closely corresponding to the obtained temperature signature.

9. The printer of claim 1, wherein the controller embodies a logic structure to generate a predetermined amount of heat in a predetermined pattern for a predetermined time period on a first surface of the print media.

* * * * *